United States Patent [19]

Klein

[11] 4,011,742

[45] Mar. 15, 1977

[54] LOCK DEVICE

[75] Inventor: Raymond J. Klein, North Hollywood, Calif.

[73] Assignee: Dialoc Corporation of America, Denison, Iowa

[22] Filed: Aug. 4, 1975

[21] Appl. No.: 601,584

[52] U.S. Cl. ..... 70/305; 70/150; 70/314

[51] Int. Cl.[2] ..... E05B 37/02

[58] Field of Search ..... 70/150, 151, 152, 153, 70/305, 306, 314; 292/347

[56] References Cited

UNITED STATES PATENTS

| | | | |
|---|---|---|---|
| 832,417 | 10/1906 | Rice | 70/314 X |
| 1,516,152 | 11/1924 | Dumont | 292/347 |
| 1,801,299 | 4/1931 | Ashton | 70/314 |
| 2,069,572 | 2/1937 | Berggren | 70/305 |
| 2,640,344 | 6/1953 | Margo | 70/314 X |
| 3,295,342 | 1/1967 | Etter | 70/153 |
| 3,369,382 | 2/1968 | Russell et al. | 70/314 X |
| 3,747,377 | 7/1973 | VanDeudekom | 70/314 X |

*Primary Examiner*—Robert L. Wolfe
*Attorney, Agent, or Firm*—Zarley, McKee, Thomte & Voorhees

[57] ABSTRACT

A lock device comprises a latch bolt assembly movably mounted for movement from a closed position to a open position. A combination lock system is operatively connected to the latch bolt for retentively engaging the latch bolt against movement to its open position, and for releasing the latch bolt assembly in response to a predetermined rotational movement of a dial on the lock mechanism. A handle or knob is operatively connected to the latch for opening the latch whenever the lock mechanism has released the latch. A reset mechanism is connected to the knob and also engages the lock mechanism so as to reset the lock mechanism each time the handle opens the latch whereby the lock mechanism will automatically move into retentive engagement with the latch bolt after the latch bolt has been opened.

4 Claims, 8 Drawing Figures

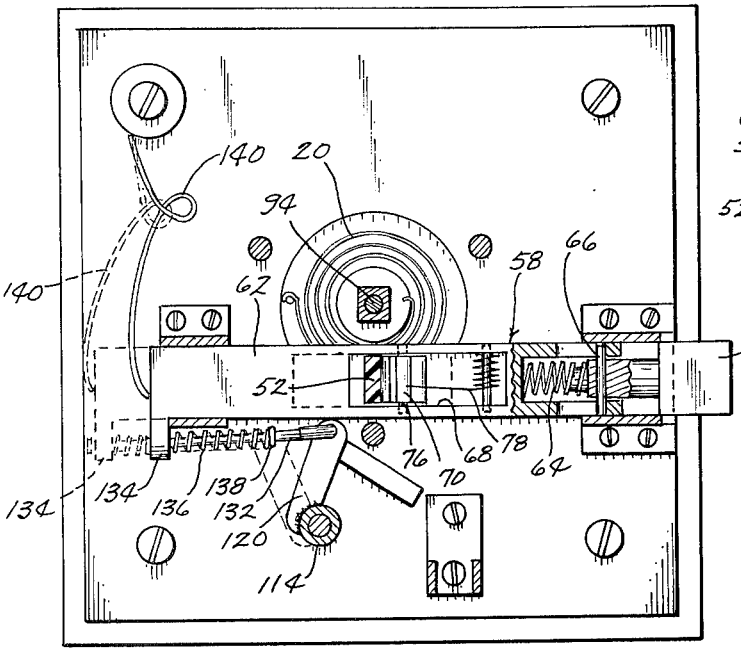
Fig. 4
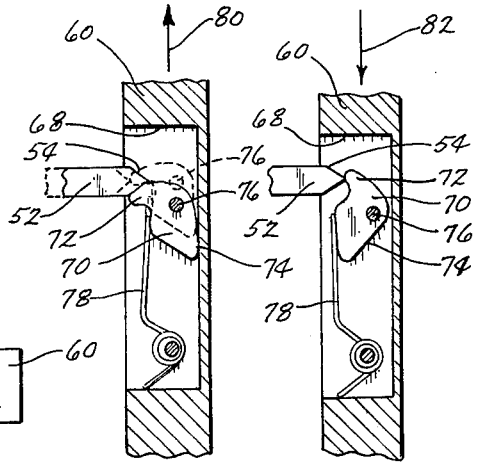
Fig. 6
Fig. 7
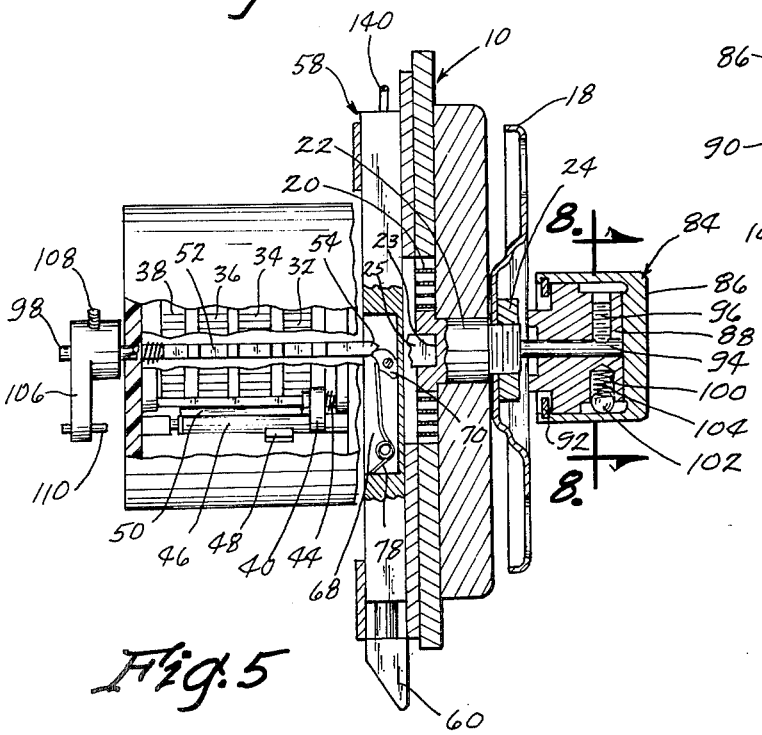
Fig. 5
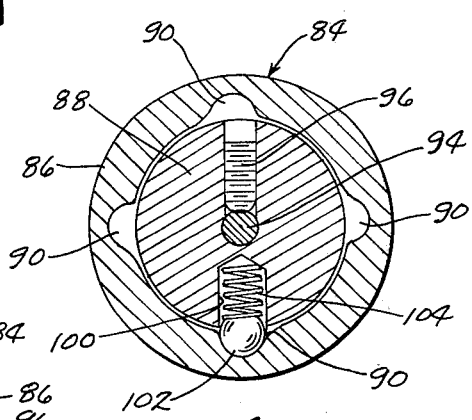
Fig. 8

LOCK DEVICE

SUMMARY OF THE INVENTION

This invention relates to lock devices and specifically to combination locks for doors which are opened only from one side such as safes, lockers, and the like.

A locking device which utilizes a telephone dial for dialing the lock combination is shown in U.S. Pat. No. 3,295,343. The device shown in patent 3,295,342 is adapted for use with doors having knobs or handles on opposite sides thereof. The lock is opened by dialing a telephone dial to the correct combination. A lock mechanism is connected to the telephone dial and is responsive thereto to open the latch bolt of the door.

Certain unique problems are encountered, however, in safes, lockers, or other devices similar thereto. It is important that the device lock automatically every time the door is shut. Otherwise, the operator could inadvertently forget to reset the lock and the door would remain unlocked after being closed. Another problem encountered with locks of this type occurs when the door knob is forced even though the lock mechanism remains in a locked condition. This often results in damage to the parts of the lock.

The present invention utilizes the basic telephone dial lock mechanism shown in U.S. Pat. No. 3,295,342. However, mechanism is provided for resetting the lock mechanism each time the latch bolt is open so that the door will be in a locked condition whenever the door is shut again. Furthermore, a clutch mechanism is provided on the door knob for permitting the door knob to slip in the event it is forced with the lock in a locked condition.

Therefore, a primary object of the present invention is the provision of a lock mechanism which automatically resets upon opening of the latch.

A further object of the present invention is the provision of a lock mechanism which includes a slip clutch for causing the latch knob to slip whenever the latch is locked and is incapable of movement.

A further object of the present invention is the provision of a device which is easily operated and which permits the lock combination to be dialed in the same fashion as is done with a telephone dial.

A further object of the present invention is the provision of a device which is simple in construction, economical to manufacture, and durable in use.

BRIEF DESCRIPTION OF THE FIGURES OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

FIGS. 3, 4 and 5 are sectional views taken along lines 3—3, 4—4, and 5—5 of FIG. 2.

FIG. 6 is an enlarged detailed view of a portion of the latch bolt, illustrating the latch bolt movement to the open position.

FIG. 7 is a view similar to FIG. 6 illustrating the movement of the latch bolt to its closed position.

FIG. 8 is a sectional view taken along line 8—8 of FIG. 5.

DETAILED DESCRIPTION

Figure 1:
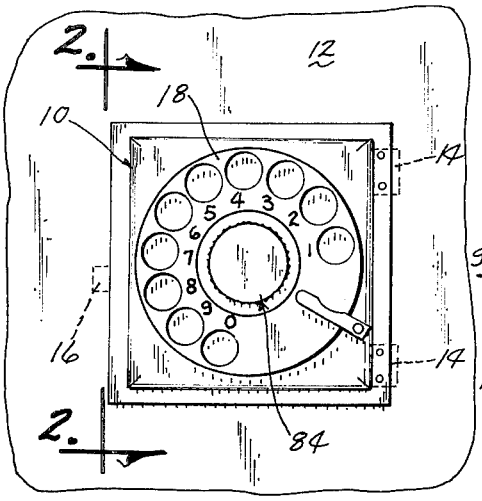
FIG. 1 is a front view of a door utilizing the lock of the present invention.

Referring to FIG. 1, a door 10 is shown hinged to a wall 12 by means of a pair of hinges 14. Wall 12 is provided with a latch receptacle 16.

Mounted on the front of door 10 is a dial 18 which is spring mounted by means of a spring 20 (FIG. 4) so as to return to its original position after being rotated in the manner similar to a telephone dial. Dial 18 is fixedly mounted to a dial shaft 22 (FIG. 5) by means of a lock nut 24. Dial shaft 22 extends through door 10 and includes a square receptacle 23 which retentively engages a square shaft 25 of a lock mechanism 26.

Shaft 22 and square shaft 25 each include a longitudinal bore 28 extending therethrough.

Lock mechanism 26 includes a housing 30, a plurality of ratchet wheels 32, 34, 36, 38, rotatably mounted therein, a stepping pawl 40, a stepping pawl shaft 42, and a stepping pawl spring 44. Also, within housing 30 is a reset bar 46 having a cam dog 48 thereon and also having an elongated flange 50 on one side thereof. A control bar 52 (FIGS. 2 and 5) extends through lock mechanism 26 and includes a tapered end 54 which protrudes outwardly from housing 30 at one end thereof.

The above structure of lock mechanism is shown and described in U.S. Pat. No. 3,295,342. Normally lock mechanism 26 is in a locked condition wherein control bar 52 is held against longitudinal movement. Mechanism 26 can be converted to an unlocked condition by dialing the correct predetermined digits on mechanism 18. In the device illustrated in the drawings, the lock mechanism 26 can be set to respond to a combination of four digits. Prior to the time that the initial digit is dialed, stepping pawl 40 is in the position shown in FIG. 5. As the first digit is dialed, pawl 40 engages ratchet 32 and rotates ratchet 32. If the correct digit is dialed, mechanism (not shown) within lock mechanism 26 permit stepping pawl 40 to slide along pawl shaft 42 in response to pressure from spring 34. Thus when the second digit is dialed, pawl 40 acts upon the second ratchet 34. Pawl 40 continues stepping to the left as viewed in FIG. 5 until it reaches the position shown in FIG. 2. As the last correct digit is dialed, the ratchets release control bar 52 and permit it to slide to the left as viewed in FIGS. 2 and 5.

Lock mechanism 26 can be reset by doing two things. First, pawl 40 must be moved to the right to its reset position shown in FIG. 5. Secondly, reset bar 46 must be rotated so that flange 50 can release a plurality of locking pawls (not shown) which engage ratchets 32, 34, 36, and 38 so that the ratchets can rotate to their original positions. The ratchets are spring mounted so that they will automatically return to their original positions once they are released by flange 50.

The above structure is shown and described in more detail in U.S. Pat. No. 3,295,342. The present invention focuses upon the use of this mechanism in a door which need only be opened from one side, and which must be reset to its locked position automatically upon opening. The resetting operation is done by moving pawl 40 to the right to its original position and also by rotating reset bar 46 so as to release the ratchets so they may return to their original position.

A latch bolt assembly 58 includes a beveled latch 60, telescopically mounted within the end of the latch bolt 62. A spring 64 spring biases latch 60 to an extended position, and a retaining flange 66 engages latch bolt 62 so as to limit the outward movement of latch 60 within latch bolt 62. A cavity 68 within latch bolt 62 is shown in detail in FIGS. 5, 6 and 7. Mounted within cavity 68 is a cam 70 having a finger 72 on one end thereof and a flat stop surface 74 on the other end thereof. A spring 78 engages cam 70 and biases it to the position shown in FIG. 6 wherein stop surface 74 engages the back wall of cavity 68.

Tapered end 54 of control bar 52 protrudes within cavity 68 and engages finger 72 of cam 70. When control bar 52 is in a locked condition, tapered end 54 engages finger 52 and prevents latch bolt 60 from moving to its open position or in the direction indicated by arrow 80 in FIG. 6. When control bar 52 is released and permitted to move longitudinally to the left as viewed in FIG. 6, it permits latch bolt 60 to move to its open position in the direction indicated by arrow 80. Latch bolt 60 can easily return to its closed position in the direction indicated by arrow 82 of FIG. 7. This movement is permitted by virtue of the fact that cam 70 can rotate in a clockwise direction in response to the engagement of finger 72 with tapered end 54 of control bar 52. Thus latch bolt 60 can move to its closed position even if control bar 52 is locked against longitudinal movement.

A handle or knob 84 is provided for opening latch bolt 60 whenever the correct combination has been dialed on dial mechanism 18. Knob 84 includes an outer member 86 (FIGS. 5 and 8), and an inner member 88. Outer member 86 includes a cavity therein which has a plurality of cam slots 90 along its inner perimeter. Inner member 88 is cylindrical in shape and is seated within the cavity of outer member 86. A retaining ring 92 locks inner member 88 within outer member 86. A knob shaft 94 extends through inner member 88 and is retentively held therein by means of a set screw 96. Knob shaft 94 extends through bore 28 of dial shaft 22 and then through the longitudinal axis of lock mechanism 26, with the distal end 98 of knob shaft 94 protruding rearwardly from the back of lock mechanism 26 (see FIG. 2).

Inner member 88 includes a radial bore 100 therein in which is seated a detent ball 102 which is spring biased outwardly by means of a coil spring 104. Detent ball 102 retentively engages one cam slot 90 so as to hold inner member 88 against rotational movement with respect to outer member 86.

Mounted on distal end 98 of knob shaft 94 is a crank arm 106 which is fixed to knob shaft 94 by means of a set screw 108. A link 110 is pivotally mounted to the end of crank arm 106 and extends downwardly therefrom to its lower end which is pivotally connected to a link arm 112 which is an integral part of a rotatable sleeve 114. Sleeve 114 is rotatably mounted about an axis which extends parallel to the rotational axis of knob shaft 94. Extending outwardly from sleeve 114 is a reset cam arm 116 having a reset cam head 118 on the other end thereof. At the opposite end of sleeve 114 is an outwardly extending latch arm 120. A bracket 122 is rigidly secured to door 10 and pivotally supports a reset lever 124 for pivotal movement about a horizontal axis. Lever 124 has a cam receiving surface 126 adapted to receive cam head 118. Lever 124 also has a shoulder 128 for engaging dog 48 of reset bar 46. The upper end of lever 124 includes a finger 130 for engaging stepping pawl 40.

Referring to FIG. 4, latch arm 120 is pivotally secured at its outer end to a link 132. Link 132 slidably extends through an ear 134 at the end of latch bolt 62. A coil spring 136 is yieldably compressed between ear 134 and flange 138 on link 132. Thus spring 132 can slide to the left through ear 134 against the bias of spring 136.

In operation, lock mechanism 26 is normally in a locked condition which holds control bar 52 against longitudinal movements. In this condition tapered end 54 of control bar 52 engages cam 70 as shown in FIG. 6 so as to prevent movement of latch bolt 62 to the left as viewed in FIG. 4. This keeps door 10 in a locked condition. If a person attempts to turn knob 84 to open the lock without using the proper combination, the rotational torque will be transferred through crank arm 106, link 110 and link arm 112 so as to rotate sleeve 114. Referring to FIG. 4, since latch bolt 62 is held against longitudinal movement, the rotational movement of sleeve 114 is absorbed by spring 136. If continued rotational force is applied to knob 84, the resistance of spring 136 will eventually be so great that detent balls 102 will be unseated from cam slots 90 (FIG. 8) and outer member 86 will slip with respect to inner member 88. This will prevent damage to the working parts of the latch bolt assembly and the other components of the present invention.

Figure 2:
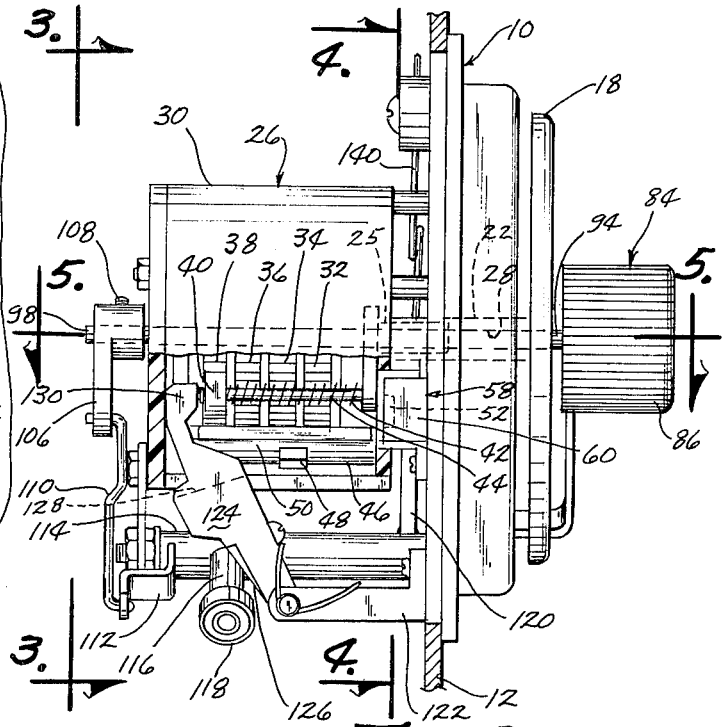
FIG. 2 is a sectional view taken along line 2—2 of FIG. 1.
Figure 3:
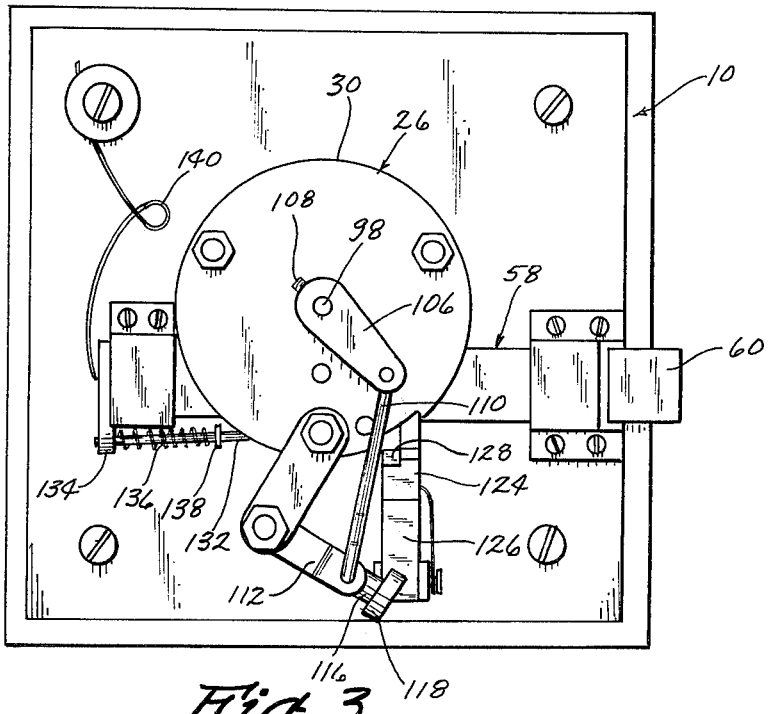

When the operator dials the correct digits on dial mechanism 18, the stepping pawl 40 will continue stepping to the left as viewed in FIG. 2 until the correct combination of digits has been dialed. Once the last correct digit is dialed, lock mechanism 26 is in an unlocked condition and control bar 52 is free to slide longitudinally out of engagement with cam 72. Thus rotation of knob 84 causes spring 136 to urge latch bolt 62 to the left as viewed in FIG. 4. Control bar 52 cams to the left (FIG. 6) as a result of the tapered end 54. This permits latch bolt 62 to move to the left and to permit the door to be opened.

Rotation of knob 84 also causes cam head 118 to be lifted upwardly as viewed in FIG. 2 so that it engages lever 124 and pivots it in a clockwise direction about its pivotal axis. This clockwise rotation causes finger 130 to engage stepping pawl 40 and move it to the right as viewed in FIG. 2. Simultaneously, shoulder 128 of lever 124 engages dog 48 and cams against dog 48 so as to rotate reset bar 46 which causes reset bar 46 to release ratchets 32, 34, 36 and 38 so that they may return to their reset position. Thus, simultaneously with the opening of latch bolt 62, the rotation of knob 84 also causes the resetting of lock mechanism 26 to its locked condition. When the operator releases knob 84, a spring 140 (FIG. 4) urges latch bolt 62 back to the right to its original locked position. Cam 70 pivots out of the path of tapered end 54 of control bar 52 during this movement as viewed in FIG. 7.

Thus the latch bolt has been automatically reset to a locked position simultaneously with the opening of the latch bolt. Similarly, a clutch mechanism has been provided for preventing damage to the lock in the event that an attempt is made to force knob 84 when the lock is in an unlocked condition. Thus it can be seen that the device accomplishes at least all of its stated objectives.

What is claimed is:

1. A lock device comprising support means;

a latch bolt assembly movably mounted on said support means for movement from a closed position to an open position;

a control member movable from a locked position retentively engaging said latch bolt assembly to an unlocked position freeing said latch bolt assembly for movement to its open position;

a plurality of ratchets within said lock mechanism, said ratchets normally retentively engaging said control member and holding said control members against movement to said unlocked position, said ratchets being rotatable to a predetermined position to release said control member and permit said control member to move to said unlocked position;

spring means for yieldably urging said ratchets away from said predetermined position;

a manually operable rotating member;

pawl means movable from an initial position engaging one of said ratchets to a plurality of stepping positions engaging the remainder of said ratchets one at a time, said rotating member being drivingly connected to said pawl means for moving said pawl means and causing rotation of the ratchet engaged by said pawl means;

a reset bar having a flange thereon engaging said ratchets for preventing rotation of said ratchets in the direction urged by the spring means, said reset bar being movable out of engagement with said ratchets for permitting said ratchets to rotate in response to said spring means;

a rotatable knob operatively connected to said latch bolt assembly for causing movement of said latch bolt assembly to its open position;

reset mechanism drivingly connected to said rotatable member, said reset mechanism including a first reset member engageable with said pawl means and engageable with said reset bar, said first reset member being movable in response to rotation of said knob and opening of said latch bolt assembly to move said pawl means to its initial position and to move said reset bar out of engagement with said ratchets whereby said ratchets will rotate to their normal position retentively holding said control member against movement to said unlocked position.

2. A device according to claim 1 wherein a shaft fixed to said knob for rotation therewith, said shaft having a crank arm thereon; a linkage interconnecting said crank arm to a rotatable member having a cam arm thereon; said reset member being pivotally mounted for swinging movement, said shaft, crank arm and linkage causing said rotatable member to rotate in response to rotation of said knob whereby said cam arm will engage and swing said reset member about its pivotal axis.

3. A device according to claim 2 wherein said reset member comprises a finger for engaging said pawl means and a shoulder for engaging said reset bar.

4. A device according to claim 1 wherein said rotatable member comprises a rotatable knob, said knob having inner and outer members rotatably mounted with respect to one another, yieldable slip clutch means being between said inner and outer members to cause said inner and outer members to rotate in unison normally, said clutch means being releasable in response to a predetermined magnitude of opposite rotational forces between said inner and outer members whereby said outer member will rotate with respect to said inner member.

* * * * *